US005582120A

United States Patent [19]

Holl et al.

[11] Patent Number: 5,582,120

[45] Date of Patent: Dec. 10, 1996

[54] PRESSER FOOT FOR PREPARING PIPING AND ORNAMENTAL SEAMS

[75] Inventors: Helmar Holl, Karlsruhe; Peter Schuett, Karlsbad, both of Germany

[73] Assignee: G.M. Pfaff Aktiengesellschaft, Kaiserslautern, Germany

[21] Appl. No.: 507,812

[22] Filed: Jul. 27, 1995

[30] Foreign Application Priority Data

Aug. 18, 1994 [DE] Germany ..... 94 13 325.5

[51] Int. Cl.[6] ..... D05B 29/08

[52] U.S. Cl. ..... 112/240

[58] Field of Search ..... 112/235, 236, 112/240, 475.18, 439

[56] References Cited

U.S. PATENT DOCUMENTS

| | | | |
|---|---|---|---|
| 1,944,515 | 1/1934 | Karle | 112/235 |
| 2,934,031 | 4/1960 | Graf | 112/235 |
| 3,003,444 | 10/1961 | Gary | 112/235 |
| 3,143,094 | 8/1964 | Yamada | 112/235 |
| 3,150,621 | 9/1964 | Warnock | 112/235 X |

*Primary Examiner*—Ismael Izaguirre
*Attorney, Agent, or Firm*—McGlew and Tuttle

[57] ABSTRACT

A presser foot is provided with a detachably arranged base. The base contains a needle passage opening and includes a plurality of guide grooves located at mutually spaced locations from one another on the under side of the base. The guide grooves are used for preparing pipings which extend in parallel to one another in the fabric. The middle guide groove extends centrally to the needle passage opening. The width of the needle passage opening essentially corresponds to a maximum overstitch width of the needle of a zig-zag sewing machine. A second and third guide groove extend, in a short distance, to the side of the needle passage opening. A fourth guide groove is provided with a distance from the middle guide groove which exactly corresponds to the mutual distance between the second and third guide grooves.

9 Claims, 1 Drawing Sheet

PRESSER FOOT FOR PREPARING PIPING AND ORNAMENTAL SEAMS

FIELD OF THE INVENTION

The present invention pertains to a sewing machine presser foot with a detachably arranged base, which contains a needle passage opening and, a plurality of guide grooves located at mutually spaced locations from one another on the under side of the base, the grooves for preparing pipings extending in parallel to one another in the fabric, a middle guide groove of the guide grooves extends centrally to the needle passage opening.

BACKGROUND OF THE INVENTION

Presser feet as well as replaceable presser foot bases of a special design are used for preparing pipings; they have, in general, three guide grooves arranged at closely spaced locations from one another on the underside of the base, wherein the middle guide groove extends centrally to the needle passage opening of the presser foot base.

When pipings extending in parallel at a short distance from one another are prepared, the piping sewn before is guided in one of the two outer guide grooves. It has been known that an adjustable guide rule, to be arranged on the presser foot shaft, can be used to prepare pipings located at a great mutual distance from one another.

If an ornamental seam, to be formed, e.g., by using the zigzag sewing unit of the sewing machine, is to be formed in a subsequent operation between two or more pipings located at a relatively great distance from one another, the piping foot, which is unsuitable for other sewing operations, must first be replaced, together with the guide rule, with an appropriate foot for the ornamental seams.

SUMMARY AND OBJECTS OF THE INVENTION

The basic task of the present invention is to provide a presser foot, which is suitable for preparing pipings located at a relatively great distance from one another and for the subsequent preparation of an ornamental seam between two alike pipings.

According to the invention, a presser foot is provided with a detachably arranged base. The base contains a needle passage opening and includes a plurality of guide grooves located at mutually spaced locations from one another on the under side of the base. The guide grooves are used for preparing pipings which extend in parallel to one another in the fabric. The middle guide groove extends centrally to the needle passage opening. The width of the needle passage opening essentially corresponds to a maximum overstitch width of the needle of a zig-zag setting of a zig-zag sewing machine. A second and third guide groove extend, in a short distance, to the side of the needle passage opening. A fourth guide groove is provided with a distance from the middle guide groove which exactly corresponds to the mutual distance between the second and third guide grooves.

Based on the special arrangement of the guide grooves, the sewing of pipings and the subsequent preparation of ornamental seams can now be carried out in a particularly simple manner by means of the presser foot according to the present invention. The first piping is formed before being taken up in the outer, fourth guide groove during the sewing of the second piping, so that the second piping is formed at a distance from the first piping which is greater than the width of the ornamental seam that can subsequently be prepared by means of this presser foot. Consequently, it is now neither necessary to use a guide rule, nor does the presser foot used for piping need to be replaced with another presser foot for the subsequent sewing of the ornamental seam.

If a third piping is to be sewn at the same distance from the adjacent, second piping as the first two pipings, this can be done in the same manner as during the sewing of the second piping, and the second and now middle piping is now taken up in the outer, fourth guide groove.

However, if the middle piping is to be sewn first for reasons of better placement of the entire ornamental seam area comprising all pipings in the case of the sewing or three or more, odd-number pipings, two possibilities are available for carrying out this method. One of them is that the base of the presser foot according to the present invention is widened by the same amount on the side located opposite the fourth guide groove, and a fifth guide groove, whose distance from the middle guide groove is equal to the distance between the fourth guide groove and the middle guide groove, is formed there. The fourth or fifth guide groove may be optionally used as the guiding aid with this presser foot.

The other advantageous possibility is to design the base of the presser foot, which has four guide grooves and is consequently widened on one side only, symmetrically, such that the base can be used in two different alignment positions rotated by 180°, so that the fourth guide groove is located optionally to the right or to the left of the needle. The advantage of this base design and the possibility of handling resulting therefrom is the fact that, due to the base being narrower on one side, the pipings to be formed can be placed closer to an edge formed by a second or more fabric layers, e.g., a buttonhole facing, than in the case of the wider base design with five guide grooves.

Ornamental seams which have a plastic effect due to extremely short stitch lengths or repeated oversewing, are prevented from causing an increased frictional resistance on the base in that the base is recessed in height by a small amount in the area of the maximum overstitch width of the needle as well as in the area of the fourth guide groove.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
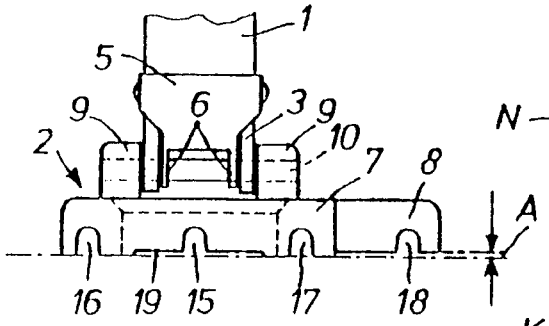
FIG. 1 is a view of the presser foot.
Figure 2:
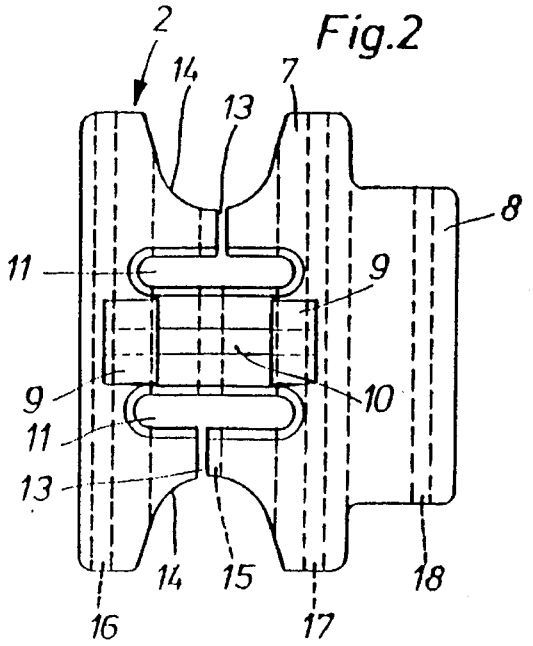
FIG. 2 is a top view of the foot base.
Figure 3:
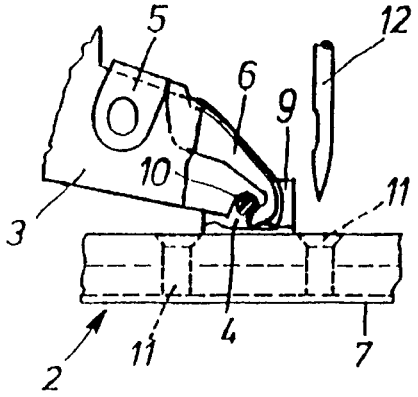
FIG. 3 is a side view of the base holder.

The presser foot comprises a shaft 1 and a detachably fastened base 2 arranged on it in an articulated manner.

A recess 4, which is open in the downward direction, is provided at the front end of a projecting, fork-shaped projection 3 of the shaft 1.

A spring clip 5, which has two hook fingers 6 extending between the two legs of the fork-shaped projection 3, is fastened to the projection 3.

The base 2 consists of the base plate 7 proper, a lateral projection 8 and two webs 9 for receiving a hinge pin 10. Two needle passage openings 11 designed as elongated holes are provided in the base plate 7 at equal distance from the hinge pin 10. The width of the needle passage openings 11 measured at right angles to the direction of sewing is adapted to the maximum overstitch width of the needle 12 during zigzag sewing. A thread slot 13 extends from each of the two needle passage openings 11 into a semicircular recess 14 in the base plate 7.

Three guide grooves 15, 16, 17, which extend in parallel to one another, and of which the middle guide groove 15 extends centrally to the two needle passage openings 11, are provided on the underside of the base plate 7. The other two guide grooves 16, 17 are each located at a short, equal distance from the ends of the two needle passage openings 11. A fourth guide groove 18 is provided on the underside of the projection 8. The distance between the fourth guide groove 18 and the middle guide groove 15 is exactly equal to the distance between the two guide grooves 16 and 17.

An area 19 of the base plate 7 located between the ends of the needle passage openings 11, as well as the entire projection 8 are recessed by the amount A in relation to the underside of the base plate 7.

With the base 2 attached to the shaft 1, the hinge pin 10 is located in the recess 4 and is pressed by the hook fingers 6 of the spring clip 5 to the top end of the recess 4 and thus held in the position of use. To replace or rotate the base 2, the front part of the base is pressed down, with the presser foot raised, and the base 2 is thus released from the holder.

Figure 4:
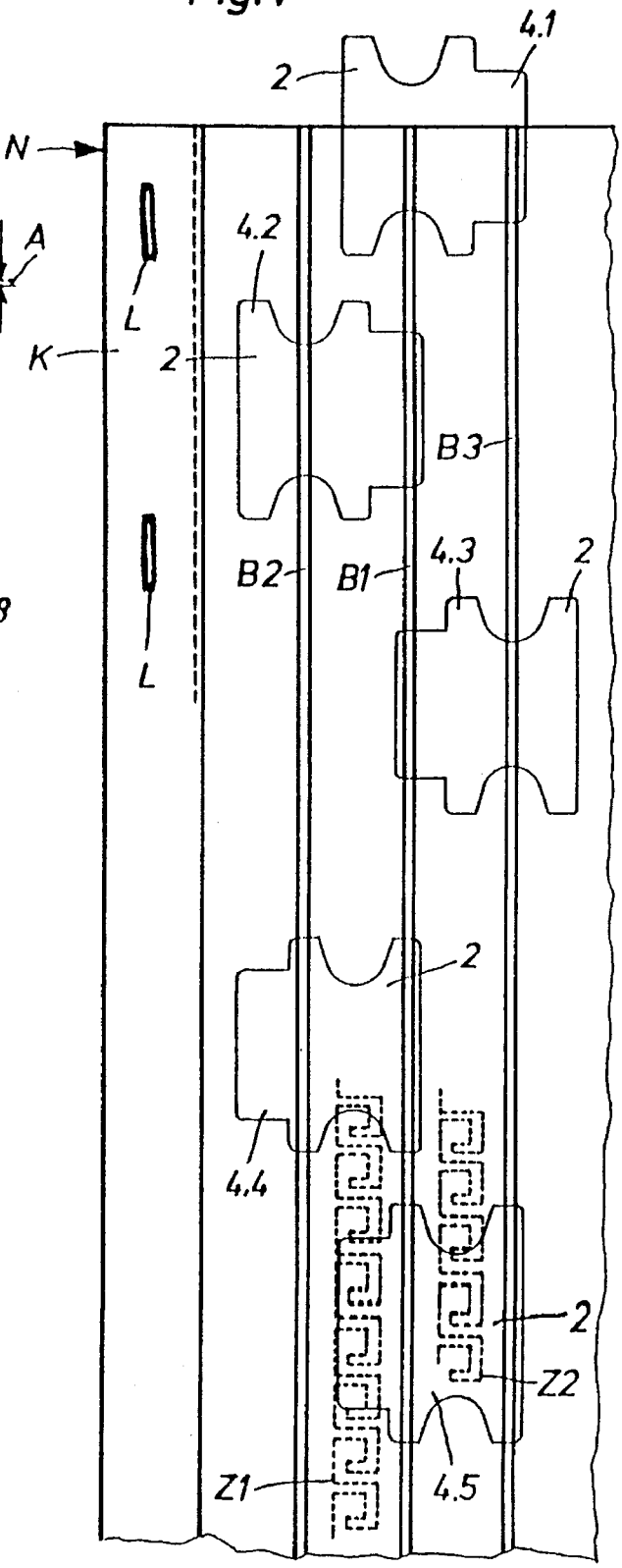
FIG. 4 is a representation of a sewing pattern with the position shown of the foot base during different sewing operations.

The fabric N shown in FIG. 4 contains a buttonhole facing K with a plurality of buttonholes L. Three pipings B1, B2, B3 are to be sewn to the side of the buttonhole facing K, and ornamental seams Z1, Z2 are to be formed between them.

The middle piping B1 is sewn first, while the base 2 is in the alignment position 4.1. The fabric N is then displaced to the right for reasons of a simplified graphic representation, the base 2 rather than the fabric N is shown in a laterally displaced position in FIG. 4 to the extent that the piping B1 is taken up by the guide groove 18 of the projection 8. The left-hand piping B2 is thus sewn at a set distance from piping B1, while the base 2 is in the alignment position 4.2, which is the same as position 4.1.

Before sewing the right-hand piping B3, the foot base 2 must be detached from the shaft I in the above-described manner and rotated by 180° into the alignment position 4.3. The right-hand piping B3 is then sewn, and the middle piping B1 is again taken up in the guide groove 18 of the projection 8.

To subsequently prepare the two ornamental seams Z1, Z2, the base 2 may remain in the alignment position (4.4, 4.5) in which it was during the sewing of the third piping B3. To form the ornamental seams Z1 and Z2, the fabric N is now placed such that two pipings, B1 and B2 or B1 and B3, are taken up by the guide grooves 16 and 17, respectively. It is thus guaranteed that the ornamental seams Z1 and Z2 can be formed in the desired manner, i.e., exactly in the middle between the pipings.

While a specific embodiment of the invention has been shown and described in detail to illustrate the application of the principles of the invention, it will be understood that the invention may be embodied otherwise without departing from such principles.

What is claimed is:

1. A presser foot for a needle zig-zag sewing machine having a needle zig-zag maximum overstitch width, comprising:

a detachable base including a needle passage opening and a plurality of guide grooves located at mutually spaced locations from one another on the under side of said base, said guide grooves being shaped for preparing and guiding pipings extending in parallel to one another in the fabric, said plurality of guide grooves including a middle guide groove extending centrally to said needle passage opening, said needle passage opening having a width substantially corresponding to said needle zig-zag maximum overstitch width, said plurality of grooves including a second guide groove extending a short distance to one side of said needle passage opening, a third guide groove extending said short distance to another side of said needle passage opening and a fourth guide groove, a distance of said fourth guide groove to said middle guide groove exactly corresponding to a mutual distance between said second and third guide groove.

2. A presser foot according to claim 1, wherein said base is symmetrical whereby said base is usable in one of two alignment positions, by rotating said base by 180°.

3. A presser foot according to claim 2, wherein said base includes a recessed portion, recessed an amount by in height in an area of said maximum overstitch width of said needle.

4. A presser foot according to claim 2, wherein said base is raised in height with respect to a remainder of said base in an area of said fourth guide groove.

5. A presser foot according to claim 1, wherein said base includes a recessed portion, recessed an amount by in height in an area of said maximum overstitch width of said needle.

6. A presser foot according to claim 1, wherein said base is raised in height with respect to a remainder of said base in an area of said fourth guide groove.

7. A presser foot according to claim 1, wherein said base includes a recessed portion, said recessed portion being recessed in height in an area of said maximum overstitch width of said needle.

8. A presser foot for a sewing machine having a needle zig-zag maximum overstitch width, comprising:

a detachable base including a needle passage opening and a plurality of guide grooves located at mutually spaced locations from one another on the under side of said base, said guide grooves for preparing pipings extending in parallel to one another in the fabric, said plurality of guide grooves including a middle guide groove extending centrally to said needle passage opening, said needle passage opening having a width substantially corresponding to said needle zig-zag maximum overstitch width, said plurality of grooves including a second guide groove extending a short distance to one side of said needle passage opening and a third guide groove extending a short distance to another side of said needle passage opening and a fourth guide groove, a distance of said fourth guide groove to said middle guide groove exactly corresponding to a mutual distance between said second and third guide groove, said base being symmetrical and usable in one of two alignment positions, by rotating said base by 180°.

9. A presser foot for a sewing machine having a needle zig-zag maximum overstitch width, comprising:

a detachable base including a needle passage opening and a plurality of guide grooves located at mutually spaced locations from one another on the under side of said base, said guide grooves for preparing pipings extending in parallel to one another in the fabric, said plurality of guide grooves including a middle guide groove extending centrally to said needle passage opening, said needle passage opening having a width substantially corresponding to said needle zig-zag maximum overstitch width, said plurality of grooves including a second guide groove extending a short distance to one side of said needle passage opening and a third guide groove extending a short distance to another side of said needle passage opening and a fourth guide groove, a distance of said fourth guide groove to said middle guide groove exactly corresponding to a mutual distance between said second and third guide groove, said base being raised in height a small amount with respect to a remainder of said base in an area of said fourth guide groove.

* * * * *